US009732489B1

(12) United States Patent
Whitney

(10) Patent No.: US 9,732,489 B1
(45) Date of Patent: Aug. 15, 2017

(54) SNOW REMOVAL SYSTEM AND ASSOCIATED USE THEREOF

(71) Applicant: Linwood Whitney, Yonkers, NY (US)

(72) Inventor: Linwood Whitney, Yonkers, NY (US)

( * ) Notice: Subject to any disclaimer, the term of this patent is extended or adjusted under 35 U.S.C. 154(b) by 21 days.

(21) Appl. No.: 14/253,815

(22) Filed: Apr. 15, 2014

Related U.S. Application Data

(60) Provisional application No. 61/811,837, filed on Apr. 15, 2013.

(51) Int. Cl.
*E01H 5/04* (2006.01)
*E01H 5/10* (2006.01)

(52) U.S. Cl.
CPC ..... *E01H 5/104* (2013.01)

(58) Field of Classification Search
CPC ..... E01H 5/104; E01H 5/106; E01H 5/108; E01H 5/10
See application file for complete search history.

(56) References Cited

U.S. PATENT DOCUMENTS 3,304,632 A * 2/1967 Kotlar ..... E01H 5/104 126/343.5 R
3,452,459 A * 7/1969 Campion ..... E01H 5/104 126/343.5 A
3,464,128 A * 9/1969 Krickovich ..... E01H 5/104 126/343.5 R
3,484,961 A * 12/1969 Coslowsky ..... E01H 5/104 126/343.5 R
3,619,918 A * 11/1971 Morin ..... E01H 5/108 126/343.5 R
3,766,586 A * 10/1973 Krickovich ..... E01H 5/104 15/340.3
3,803,732 A * 4/1974 Moreno ..... E01H 5/104 126/343.5 A
4,071,966 A * 2/1978 Cohen ..... E01H 5/104 193/31 A
4,164,820 A * 8/1979 Krickovich ..... E01H 1/0845 15/340.3
5,365,681 A * 11/1994 Miranda ..... E01H 5/104 37/199
5,469,645 A * 11/1995 Aiken ..... E01H 5/104 210/743
5,588,231 A * 12/1996 Mavrianos ..... E01H 5/104 126/343.5 R
5,787,613 A * 8/1998 Derome ..... E01H 5/104 126/343.5 R
5,953,837 A * 9/1999 Clifford ..... E01H 5/104 126/343.5 R
6,305,105 B1 * 10/2001 Lowman ..... E01H 5/104 37/199

* cited by examiner

*Primary Examiner* — Jamie L McGowan
(74) *Attorney, Agent, or Firm* — Ashkan Najafi

(57) ABSTRACT

A snow removal system includes a mobile vehicle including a first motor, an actuation lever in communication with the first motor, a plow having a cavity formed therein and being in communication with the actuation lever, a blade statically connected to the plow, a second motor seated exterior of the plow, an auger in communication with the second motor and rotatably seated within the cavity, a transfer chute in communication with the plow and the auger, a collection bin in communication with the transfer chute, a heating element situated within the collection bin, and a release valve in fluid communication with the collection bin.

19 Claims, 3 Drawing Sheets

SNOW REMOVAL SYSTEM AND ASSOCIATED USE THEREOF

CROSS REFERENCE TO RELATED APPLICATIONS

This application claims the benefit of U.S. Provisional Application No. 61/811,837 filed Apr. 15, 2013, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

TECHNICAL FIELD

Exemplary embodiment(s) of the present disclosure relate to a snow removal system and, more particularly, to a snow removal system that utilizes plastic blades that scoops the snow up off the street and melts it into water for later disposal or distribution, thus vastly reducing the occurrence of potholes that scoops snow into the system.

PRIOR ART

During the winter months, cities and small towns alike employ snow removal companies to ensure that streets and roadways are clear and free of icy debris. Typically, public works establishments will maintain a fleet of snow removal vehicles to ensure that roads are safe to drive on during times of heavy snowfall. This is especially true in areas of the country where snow is a common winter occurrence. In areas where snowfall is less common, public works departments will often employ private contractors to remove snow accumulations on public streets and parking lots.

In addition to salt trucks that dispense a fine spray of rock salt over roadways in order to thwart the accumulation of snow and ice, snow plows are perhaps the most important tool in snow removal. While there are a variety of types of snow plows available, those that are most commonly used to clear streets, parking lots and other public areas are comprised of trucks, on the front of which a moveable plow is mounted. Snow plows feature angled blades that push snow to the side or straight ahead, thus clearing a surface area of snow and ice. However, the snow is left in massive piles on both sides of the driving path. Not only can this hinder left-and-right visibility for drivers, but roadside snow piles can also drop mini "avalanches" back onto the road, slowing traffic flow and increasing danger. In addition, as these piles begin to melt, the water can flow back onto the road and refreeze, leading to more driving complications.

Lastly, the snow plows themselves can cause hazards to drivers as the heavy metal blades of the plow can cause damage to the paved roads, creating large potholes that can tear up the vehicle tires and rims, resulting in costly repairs and in worse case scenarios, dangerous accidents. Further, these potholes must be filled and repaired each spring, thus costing towns, cities and taxpayers money.

Accordingly, a need remains for a snow removal system in order to overcome at least one prior art shortcoming. The exemplary embodiment(s) satisfy such a need by providing a snow removal system that utilizes plastic blades that is convenient and easy to use, lightweight yet durable in design, versatile in its applications, and designed for scooping the snow up off the street and melting it into water for later disposal or distribution, thus vastly reducing the occurrence of potholes

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a snow removal system that utilizes a plow and auger to that scoop snow off the street and melt the snow into water for later disposal or distribution, thus vastly reducing the occurrence of potholes that scoops snow into the system. These and other objects, features, and advantages of the non-limiting exemplary embodiment(s) are provided by a snow removal system including a mobile vehicle including a first motor, an actuation lever in communication with the first motor, a plow having a cavity formed therein and being in communication with the actuation lever, a blade statically connected to the plow, a second motor seated exterior of the plow, an auger in communication with the second motor and rotatably seated within the cavity, a transfer chute in communication with the plow and the auger, a collection bin in communication with the transfer chute, a heating element situated within the collection bin, and a release valve in fluid communication with the collection bin.

In a non-limiting exemplary embodiment, the vehicle has an interior cabin wherein first motor is located posterior of the interior cabin and the second motor is located anterior of the interior cabin.

In a non-limiting exemplary embodiment, the actuation lever extends from the collection bin and passes through the interior cabin and exits from an anterior face of the vehicle.

In a non-limiting exemplary embodiment, the first motor causes the actuation lever to rise and fall along a vertical path thereby upwardly and downwardly displacing the plow at a location anterior of the interior cabin.

In a non-limiting exemplary embodiment, the auger rotates about a fulcrum axis passing through a longitudinal length of the plow and registered orthogonal to the vertical path.

In a non-limiting exemplary embodiment, the transfer chute has a distal end located above the auger and coupled to the plow. Such a transfer chute further has a proximal end located above the distal end and coupled to the collection bin.

In a non-limiting exemplary embodiment, the collection bin is bifurcated. In this manner, the collection bin includes a snow melting section containing the heating element, and a fluid retaining section in communication with the snow melting section.

In a non-limiting exemplary embodiment, the snow melting section is located upstream of the fluid retaining section.

In a non-limiting exemplary embodiment, the release valve is in fluid communication with the fluid retaining section.

The present disclosure further includes a method of utilizing a snow removal system including the steps of: providing a mobile vehicle by performing the sub-steps of: providing a first motor; providing and communicating an actuation lever with the first motor; providing a plow having a cavity formed therein; communicating the plow with the actuation lever; providing and statically connecting a blade to the plow; providing and seating a second motor exterior of the plow; providing and communicating an auger with the second motor; rotatably seating the auger within the cavity; providing and communicating a transfer chute with the plow and the auger; providing and communicating a collection bin with the transfer chute; providing and situating a heating element within the collection bin; and providing and fluidly communicating a release valve with the collection bin.

The method further includes the steps of: the plow cooperating with the auger thereby displacing snow through the transfer chute and into the collection bin; the heating element melting the snow within the collection bin; and the release valve discharging the melted snow out from the collection bin.

There has thus been outlined, rather broadly, the more important features of non-limiting exemplary embodiment (s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
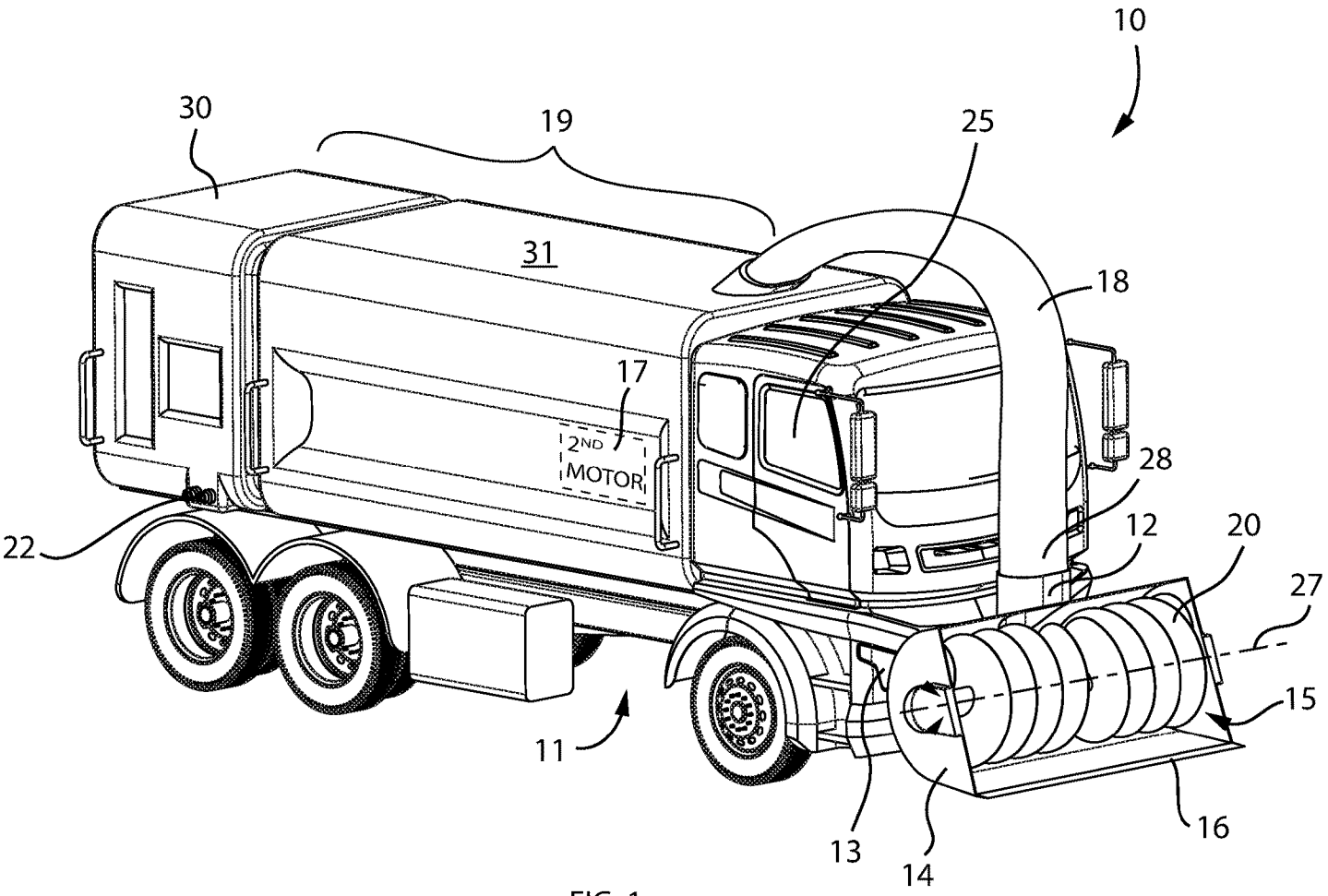
FIG. 1 is a perspective view of a snow removal system, in accordance with a non-limiting exemplary embodiment.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment (s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

Figure 2:
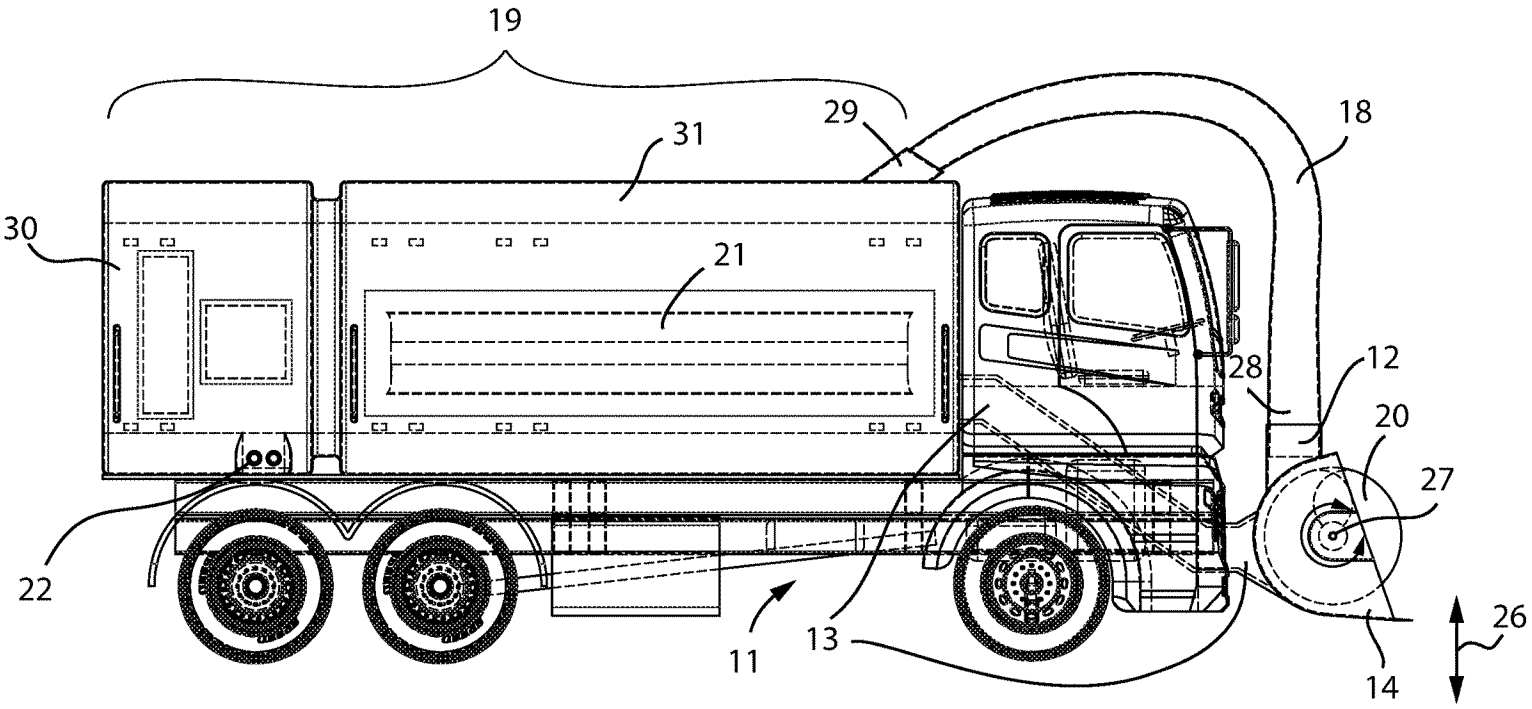
FIG. 2 is a side elevational view thereof.
Figure 4:
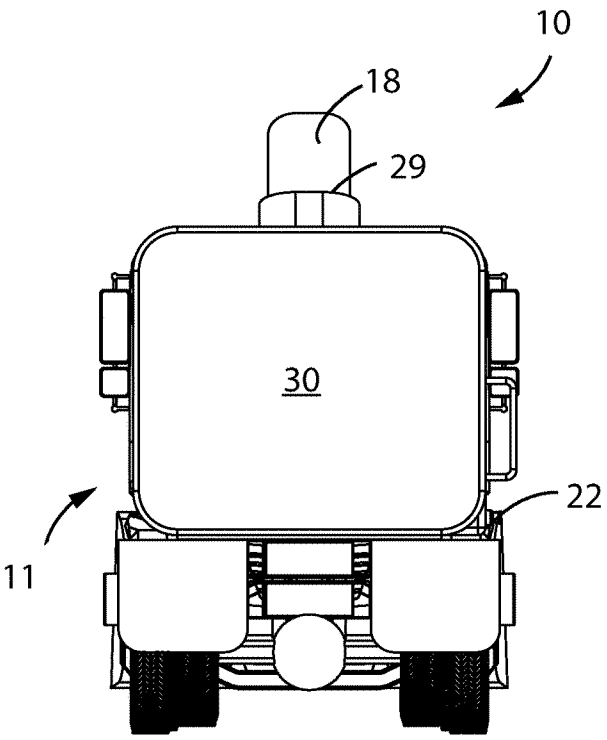
FIG. 4 is a rear elevational view thereof.
Figure 3:
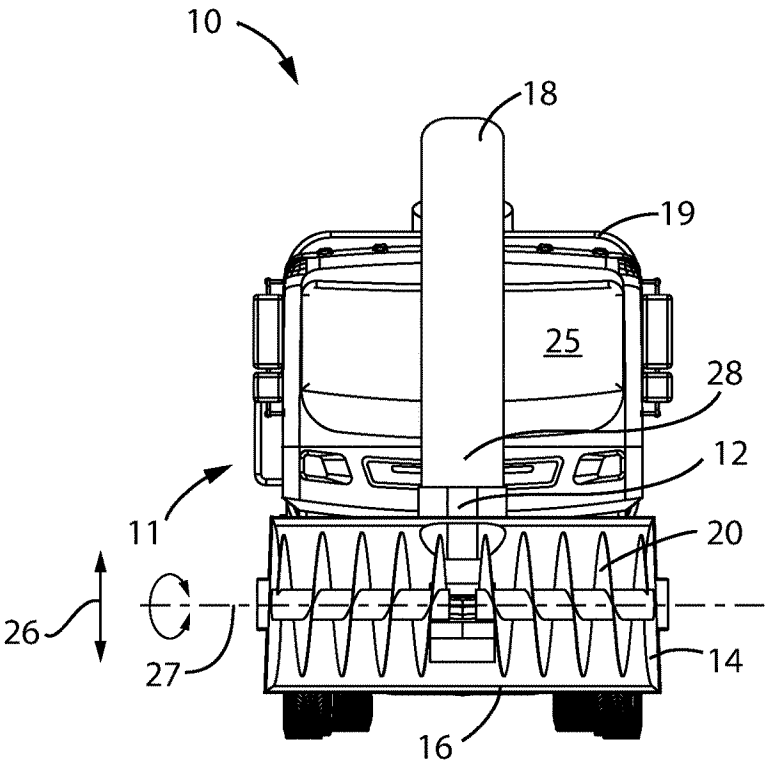
FIG. 3 is a front elevational view thereof.

The non-limiting exemplary embodiment(s) is/are referred to generally in FIGS. 1-4 and is/are intended to provide a snow removal system 10 including a mobile vehicle 11 including a first motor 12, an actuation lever 13 in communication with the first motor 12, a plow 14 having a cavity 15 formed therein and being in communication with the actuation lever 13, a blade 16 statically connected to the plow 14, a second motor 17 seated exterior of the plow 14, an auger 20 in communication with the second motor 17 and rotatably seated within the cavity 15, a transfer chute 18 in communication with the plow 14 and the auger 20, a collection bin 19 in communication with the transfer chute 18, a heating element 21 situated within the collection bin 19, and a release valve 22 in fluid communication with the collection bin 19.

In a non-limiting exemplary embodiment, the vehicle 11 has an interior cabin 25 wherein first motor 12 is located posterior of the interior cabin 25 and the second motor 17 is located anterior of the interior cabin 25.

In a non-limiting exemplary embodiment, the actuation lever 13 extends from the collection bin 19 and passes through the interior cabin 25 and exits from an anterior face of the vehicle 11.

In a non-limiting exemplary embodiment, the first motor 12 causes the actuation lever 13 to rise and fall along a vertical path 26 thereby upwardly and downwardly displacing the plow 14 at a location anterior of the interior cabin 25.

In a non-limiting exemplary embodiment, the auger 20 rotates about a fulcrum axis 27 passing through a longitudinal length of the plow 14 and registered orthogonal to the vertical path 26.

In a non-limiting exemplary embodiment, the transfer chute 18 has a distal end 28 located above the auger 20 and coupled to the plow 14. Such a transfer chute 18 further has a proximal end 29 located above the distal end 28 and coupled to the collection bin 19.

In a non-limiting exemplary embodiment, the collection bin 19 is bifurcated. In this manner, the collection bin 19 includes a snow melting section 31 containing the heating element 21, and a fluid retaining section 30 in communication with the snow melting section 31.

In a non-limiting exemplary embodiment, the snow melting section 31 is located upstream of the fluid retaining section 30.

In a non-limiting exemplary embodiment, the release valve 22 is in fluid communication with the fluid retaining section 30.

The present disclosure further includes a method of utilizing a snow removal system 10 including the steps of: providing a mobile vehicle 11 by performing the sub-steps of: providing a first motor 12; providing and communicating an actuation lever 13 with the first motor 12; providing a plow 14 having a cavity 15 formed therein; communicating the plow 14 with the actuation lever 13; providing and statically connecting a blade 16 to the plow 14; providing and seating a second motor 17 exterior of the plow 14; providing and communicating an auger 20 with the second motor 17; rotatably seating the auger 20 within the cavity 15; providing and communicating a transfer chute 18 with the plow 14 and the auger 20; providing and communicating a collection bin 19 with the transfer chute 18; providing and situating a heating element 21 within the collection bin 19; and providing and fluidly communicating a release valve 22 with the collection bin 19.

The method further includes the steps of: the plow 14 cooperating with the auger 20 thereby displacing snow through the transfer chute 18 and into the collection bin 19; the heating element 21 melting the snow within the collection bin 19; and the release valve 22 discharging the melted snow out from the collection bin 19.

A non-limiting exemplary embodiment of the present disclosure is referred to generally in the figures and is intended to provide a snow removal system 10 that utilizes a plastic blade 16, plow 14 and auger 20 that scoop the snow up off the street and melt it into water for later disposal or distribution, thus vastly reducing the occurrence of potholes. It should be understood that the exemplary embodiment may be used to scoop/melt many different types of snow, and should not be limited to any particular snow described herein.

Referring to the figures in general, in a non-limiting exemplary embodiment, the snow removal system 10 is designed for roadways; scoops snow into the system 10 and melts it into water for later disposal or distribution. In this manner, the product would eliminate the dangerous and unappealing snow piles left on the side of the road as a result of conventional roadway accumulation removal methods. The snow removal system 10 would be a heavy duty, motorized piece of wheeled machinery that would collect and remove snow directly from the roadway surface.

The vehicle 11 would feature, at its proximal end 29, a durable plow 14 designed to easily cut through and scoop up hard-packed snow. Notably, this plow 14 would be comprised of recycled plastic material and would efficiently scoop snow, yet would be safe for use on roadways, vastly reducing the threat of potholes forming as snow is retrieved. The plow 14 would be connected to a wheeled assembly that lifts collected snow, with the snow passing through an auger 20 that breaks it up into tiny pieces. This collected snow then passes through a chute and is dumped or "thrown" into the actual snow removal system 10.

The snow removal system 10 would be an ample, square shaped receptacle manufactured of heavy duty aluminum or comparable metal material and lined with a series of heating coils that produce hot steam as the snow passes through. This steam would in turn melt the snow. As the snow melts, it is collected within a holding tank that comprises the rest of the unit. A drainage valve or comparable system 10 could be incorporated into the design of this holding tank, thus enabling the driver to easily empty the unit into any city sewer, river or public waterway.

As conceived, a system 10 such as the snow removal system 10 could provide those in the business of snow removal a number of significant benefits and advantages. For example, this creative idea could offer a more efficient means of snow removal following a winter storm. Directly collecting snow from streets and highways, the snow removal system 10 could alleviate the reliance on snow plows that simply scoop snow into piles on the side of the road. By collecting accumulation via the auger 20 at the front of the unit, melting the snow by way of hot steam and then storing the melted snow in a holding tank that is easily dispensed in any sewer or river, this clever concept could put an end to the risky, unsightly mounds of snow that commonly cover roadsides. An easily operated alternative to traditional snow plows, the snow removal system 10 would easily glide along the roadway, with the recycled plastic material of the plow 14 strong enough to collect heavy piles of snow, but gentle on the road surface and thus preventing potholes from occurring. This, in turn would reduce the number of road repairs which must be executed in the spring and summer months, effectively saving local government agencies, as well as taxpayers, money.

The snow removal system 10 is an innovative product concept which would offer government agencies and private contractors alike an efficient means of snow removal. Fully developed and reasonably priced, the snow removal system 10 should be very well received by all sectors who must deal with snow accumulation during the winter months.

While non-limiting exemplary embodiment(s) has/have been described with respect to certain specific embodiment (s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed is:

1. A snow removal system comprising: a mobile vehicle including
- a first motor;
- an actuation lever in communication with said first motor;
- a plow having a cavity formed therein and being in communication with said actuation lever;
- a blade connected to said plow;
- a second motor seated exterior of said plow;
- an auger in communication with said second motor and seated within said cavity;
- a transfer chute in communication with said plow and said auger;
- a collection bin in communication with said transfer chute;
- a heating element situated at said collection bin; and
- a release valve in fluid communication with said collection bin;
- wherein said second motor is housed within said collection bin;
- wherein said heating element is located along a lower section of said collection bin;
- wherein said collection bin has a continuous and uninterrupted top surface isolated from an ambient atmosphere exterior of said collection bin.

2. The snow removal system of claim 1, wherein said vehicle has an interior cabin, said first motor being located posterior of said interior cabin and said second motor being located anterior of said interior cabin.

3. The snow removal system of claim 1, wherein said actuation lever extends from said collection bin and passes through said interior cabin and exits from an anterior face of said vehicle.

4. The snow removal system of claim 1, wherein said first motor causes said actuation lever to rise and fall along a vertical path thereby upwardly and downwardly displacing said plow at a location anterior of said interior cabin.

5. The snow removal system of claim 4, wherein said auger rotates about a fulcrum axis passing through a longitudinal length of said plow and registered orthogonal to said vertical path.

6. The snow removal system of claim 1, wherein said transfer chute has a distal end located above said auger and coupled to said plow, said transfer chute further having a proximal end located above said distal end and coupled to said collection bin.

7. The snow removal system of claim 1, wherein said collection bin is bifurcated, said collection bin including
- a snow melting section containing said heating element; and
- a fluid retaining section in communication with said snow melting section.

8. The snow removal system of claim 7, wherein said snow melting section is located upstream of said fluid retaining section.

9. The snow removal system of claim 7, wherein said release valve is in fluid communication with said fluid retaining section.

10. A snow removal system comprising: a mobile vehicle including
- a first motor;
- an actuation lever in communication with said first motor;
- a plow having a cavity formed therein and being in communication with said actuation lever;
- a blade statically connected to said plow;
- a second motor seated exterior of said plow;
- an auger in communication with said second motor and rotatably seated within said cavity;
- a transfer chute in communication with said plow and said auger;
- a collection bin in communication with said transfer chute;
- a heating element situated within said collection bin; and
- a release valve in fluid communication with said collection bin;
- wherein said actuation lever has a first end directly connected to said plow and further has a second end directly connected to said collection bin;
- wherein said second end is located at a height above said plow and terminates adjacent to said heating element.

11. The snow removal system of claim 10, wherein said vehicle has an interior cabin, said first motor being located posterior of said interior cabin and said second motor being located anterior of said interior cabin.

12. The snow removal system of claim 10, wherein said actuation lever extends from said collection bin and passes through said interior cabin and exits from an anterior face of said vehicle.

13. The snow removal system of claim 10, wherein said first motor causes said actuation lever to rise and fall along a vertical path thereby upwardly and downwardly displacing said plow at a location anterior of said interior cabin.

14. The snow removal system of claim 13, wherein said auger rotates about a fulcrum axis passing through a longitudinal length of said plow and registered orthogonal to said vertical path.

15. The snow removal system of claim 10, wherein said transfer chute has a distal end located above said auger and coupled to said plow, said transfer chute further having a proximal end located above said distal end and coupled to said collection bin.

16. The snow removal system of claim 10, wherein said collection bin is bifurcated, said collection bin including
- a snow melting section containing said heating element; and
- a fluid retaining section in communication with said snow melting section.

17. The snow removal system of claim 16, wherein said snow melting section is located upstream of said fluid retaining section.

18. The snow removal system of claim 16, wherein said release valve is in fluid communication with said fluid retaining section.

19. A method of utilizing a snow removal system comprising the steps of: providing a mobile vehicle by performing the sub-steps of providing a first motor;

providing and communicating an actuation lever with said first motor;

providing a plow having a cavity formed therein;

communicating said plow with said actuation lever;

providing and statically connecting a blade to said plow;

providing and seating a second motor exterior of said plow;

providing and communicating an auger with said second motor;

rotatably seating said auger within said cavity;

providing and communicating a transfer chute with said plow and said auger;

providing and communicating a collection bin with said transfer chute;

providing and situating a heating element within said collection bin;

providing and fluidly communicating a release valve with said collection bin;

said plow cooperating with said auger thereby displacing snow through said transfer chute and into said collection bin;

said heating element melting the snow within said collection bin; and said release valve discharging the melted snow out from said collection bin;

wherein said second motor is housed within said collection bin;

wherein said heating element is located along a lower section of said collection bin;

wherein said collection bin has a continuous and uninterrupted top surface isolated from an ambient atmosphere exterior of said collection bin;

wherein said actuation lever has a first end directly connected to said plow and further has a second end directly connected to said collection bin;

wherein said second end is located at a height above said plow and terminates adjacent to said heating element.

* * * * *